US012031759B2

(12) United States Patent
Hamadate et al.

(10) Patent No.: US 12,031,759 B2
(45) Date of Patent: Jul. 9, 2024

(54) REFRIGERATION APPARATUS

(71) Applicant: DAIKIN INDUSTRIES, LTD., Osaka (JP)

(72) Inventors: Junichi Hamadate, Osaka (JP); Fumiaki Koike, Osaka (JP); Naritaka Yakura, Osaka (JP); Asahi Ono, Osaka (JP); Ayumi Kubo, Osaka (JP); Masato Okuno, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/468,243

(22) Filed: Sep. 15, 2023

(65) Prior Publication Data

US 2024/0003602 A1 Jan. 4, 2024

Related U.S. Application Data

(63) Continuation of application No. PCT/JP2022/014523, filed on Mar. 25, 2022.

(30) Foreign Application Priority Data

Mar. 31, 2021 (JP) ..... 2021-059704

(51) Int. Cl.
*F25B 41/40* (2021.01)
*F25B 41/20* (2021.01)

(52) U.S. Cl.
CPC ..... *F25B 41/40* (2021.01); *F25B 41/20* (2021.01)

(58) Field of Classification Search
CPC ..... F25B 41/20; F25B 41/24; F25B 41/40; F25B 41/42
See application file for complete search history.

(56) References Cited

U.S. PATENT DOCUMENTS 11,118,797 B2 * 9/2021 Kobayashi ..... F24F 1/46
11,175,063 B2 * 11/2021 Zhong ..... F24F 1/32
(Continued)

FOREIGN PATENT DOCUMENTS

CN 204006420 U 12/2014
JP S51-76156 U 6/1976
(Continued)

OTHER PUBLICATIONS

International Search Report issued in corresponding International Application No. PCT/JP2022/014523 dated Jun. 14, 2022 (2 pages).
(Continued)

*Primary Examiner* — Miguel A Diaz
(74) *Attorney, Agent, or Firm* — Osha Bergman Watanabe & Burton LLP

(57) ABSTRACT

A refrigeration apparatus includes: a refrigerant flow path unit that comprises plates stacked together, and in which a refrigerant flow path is disposed; first components that are functional components each including a driving unit; second components other than functional components; and a casing accommodating the refrigerant flow path unit, and the first and second components. The first components and the second components constitute a refrigerant circuit. The refrigerant flow path unit: has a first surface and a second surface on both sides in a normal direction of the plates, and is disposed in the casing in a posture with the first surface and the second surface being upstanding. The first components are connected to the first surface. The second components are connected to the second surface. The refrigerant flow path unit includes joint tubes that connect pipes linked to the second components.

11 Claims, 9 Drawing Sheets

(56) References Cited

U.S. PATENT DOCUMENTS

| | | | | |
|---|---|---|---|---|
| 2009/0260391 | A1 | 10/2009 | Shioyama et al. | |
| 2017/0115012 | A1* | 4/2017 | Kim | F24F 1/16 |
| 2022/0205693 | A1* | 6/2022 | Ikari | F25B 41/26 |
| 2022/0243968 | A1* | 8/2022 | Ohno | F25B 41/42 |
| 2023/0213250 | A1* | 7/2023 | Ohno | F25B 41/26 137/625 |

FOREIGN PATENT DOCUMENTS

| | | | | | |
|---|---|---|---|---|---|
| JP | S62-160238 | U | | 10/1987 | |
| JP | H07-198229 | A | | 8/1995 | |
| JP | H09-79616 | A | | 3/1997 | |
| JP | H09-196515 | A | | 7/1997 | |
| JP | H11-190597 | A | | 7/1999 | |
| JP | H11-223429 | A | | 8/1999 | |
| JP | 2007-147247 | A | | 6/2007 | |
| JP | 2009-018602 | A | | 1/2009 | |
| JP | 2009-58217 | A | | 3/2009 | |
| JP | 2010-151343 | A | | 7/2010 | |
| JP | 2010-156528 | A | | 7/2010 | |
| JP | 3161528 | U | | 8/2010 | |
| JP | 2013076519 | A | * | 4/2013 | |
| JP | 2016084977 | A | * | 5/2016 | |
| KR | 20110102612 | A | * | 9/2011 | |
| KR | 20110102615 | A | * | 9/2011 | |
| WO | WO-2010098610 | A2 | * | 9/2010 | F24F 1/26 |

OTHER PUBLICATIONS

Notice of Reasons for Refusal issued in corresponding Japanese Application No. 2021-059704 dated Oct. 25, 2022 (6 pages).

Decision to Grant issued in corresponding Japanese Application No. 2021-059704 dated Mar. 7, 2023 (5 pages).

English translation of the International Preliminary Report on Patentability issued in International Application No. PCT/JP2022/014523, dated Oct. 3, 2023 (6 pages).

* cited by examiner

REFRIGERATION APPARATUS

TECHNICAL FIELD

The present disclosure relates to a refrigeration apparatus.

BACKGROUND

A refrigeration apparatus including a refrigerant circuit configured to execute vapor compression refrigeration cycle operation has been known to collectively include a plurality of refrigerant pipes allowing a refrigerant to flow therein, for reduction in size of the refrigerant circuit. For example, PATENT LITERATURE 1 discloses a substrate (refrigerant flow path unit) that includes two plates stacked together and is provided therein with a refrigerant flow path. The substrate has one of surfaces connected with a compressor, an accumulator, a four-way switching valve, and the like.

PATENT LITERATURE

PATENT LITERATURE 1: Japanese Laid-Open Patent Publication No. 9-79616

SUMMARY

The present disclosure provides a refrigeration apparatus including:

- a refrigerant flow path unit that includes a plurality of plates stacked together and is provided therein with a refrigerant flow path;
- a first component and a second component constituting a refrigerant circuit; and
- a casing accommodating the refrigerant flow path unit and the first and second components, in which
- the refrigerant flow path unit has a first surface and a second surface on both sides in a normal direction of the plates, and is disposed in the casing in a posture with the first surface and the second surface being upstanding,
- the first component is connected to the first surface, and the second component is connected to the second surface.

DETAILED DESCRIPTION

One or more embodiments of the present disclosure will be described in detail hereinafter with reference to the accompanying drawings.

Figure 1:
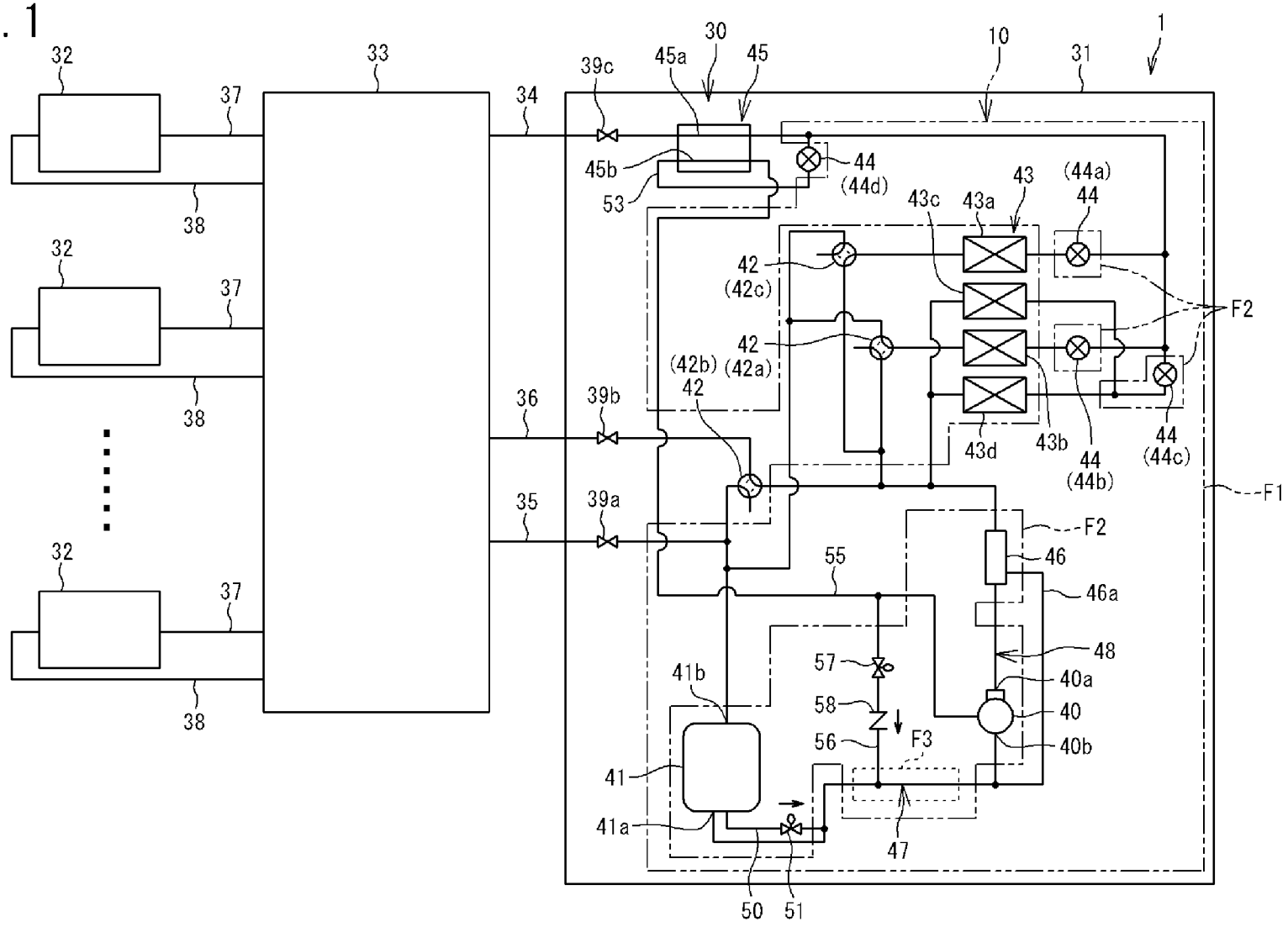
FIG. 1 is a schematic diagram depicting a refrigerant circuit of a refrigeration apparatus according to the present disclosure.

FIG. 1 is a schematic diagram depicting a refrigerant circuit of a refrigeration apparatus.

A refrigeration apparatus 1 includes a refrigerant circuit configured to execute vapor compression refrigeration cycle operation. The refrigeration apparatus 1 according to one or more embodiments functions as an air conditioner. As depicted in FIG. 1, the air conditioner 1 includes an outdoor unit 31, a plurality of indoor units 32, and a flow path switching device 33. The outdoor unit 31 and the flow path switching device 33, as well as the flow path switching device 33 and the indoor units 32, are connected via connection pipes 34, 35, 36, 37, and 38. The air conditioner 1 according to one or more embodiments is of a so-called freely cooling and heating type configured to allow each of the indoor units 32 to individually execute cooling operation or heating operation. The refrigeration apparatus 1 is not limited to the air conditioner, but may alternatively function as a refrigerator, a freezer, a hot-water supplier, or the like.

(Configuration of Refrigerant Circuit)

The outdoor unit 31 includes a refrigerant circuit 30. The refrigerant circuit 30 is connected to a refrigerant circuit in the flow path switching device 33 via a liquid connection pipe 34, a sucked gas connection pipe 35, and a high and low-pressure gas connection pipe 36. The refrigerant circuit in the flow path switching device 33 is connected to a refrigerant circuit in each of the indoor units 32 via the connection pipes 37 and 38.

The refrigerant circuit 30 includes a first shutoff valve 39*a*, a second shutoff valve 39*b*, a third shutoff valve 39*c*, a compressor 40, an accumulator 41, a plurality of flow path switching valves 42 (42*a*, 42*b*, and 42*c*), an outdoor heat exchanger 43, a plurality of expansion valves 44 (44*a*, 44*b*, 44*c*, and 44*d*), a subcooler 45, an oil separator 46, and the like. These components are connected via refrigerant pipes to constitute the refrigerant circuit. The outdoor unit 31 is provided therein with a fan 62 (see FIG. 2), a controller 61*a* (see FIG. 3), and the like.

The first shutoff valve 39*a* has a first end connected to the sucked gas connection pipe 35. The first shutoff valve 39*a* has a second end connected to a refrigerant pipe extending to reach the accumulator 41.

The second shutoff valve 39*b* has a first end connected to the high and low-pressure gas connection pipe 36. The second shutoff valve 39*b* has a second end connected to a refrigerant pipe extending to reach the flow path switching valve 42*b*.

The third shutoff valve 39*c* has a first end connected to the liquid connection pipe 34. The third shutoff valve 39*c* has a second end connected to a refrigerant pipe extending to reach the subcooler 45.

The compressor 40 has a hermetic structure incorporating a compressor motor, and is of a positive-displacement type such as a scroll type or a rotary type. The compressor 40 compresses a low-pressure refrigerant sucked from a suction pipe 47 and then discharges the compressed refrigerant from a discharge pipe 48. The compressor 40 contains refrigerating machine oil. This refrigerating machine oil occasionally circulates in the refrigerant circuit 30 along with a refrigerant. The compressor 40 is a kind of container.

The oil separator 46 is a container used to separate the refrigerating machine oil from the refrigerant discharged from the compressor 40. The refrigerating machine oil thus separated is returned to the compressor 40 via an oil return tube 46*a*.

The accumulator 41 is a container temporarily storing the low-pressure refrigerant to be sucked into the compressor 40 and used for separation between a gas refrigerant and a liquid refrigerant. The accumulator 41 has an inflow port 41*b* connected to a refrigerant pipe extending from the first shutoff valve 39*a*. The accumulator 41 has an outflow port 41*a* connected to the suction pipe 47. The accumulator 41 is connected with a first end of an oil return tube 50. The oil return tube 50 has a second end connected to the suction pipe 47. The oil return tube 50 is provided to return the refrigerating machine oil from the accumulator 41 to the compressor 40. The oil return tube 50 is provided with a first on-off valve 51. The first on-off valve 51 is an electromagnetic valve. When the first on-off valve 51 is opened, the refrigerating machine oil in the accumulator 41 passes the oil return tube 50 and is sucked into the compressor 40 along with the refrigerant flowing in the suction pipe 47.

The flow path switching valves 42 are each configured as a four-way switching valve. Each of the flow path switching valves 42 switches a refrigerant flow in accordance with an operation condition of the air conditioner 1. Each of the flow path switching valves 42 has a refrigerant inflow port connected with a refrigerant pipe extending from the oil separator 46.

The flow path switching valves 42 are each configured to shut off a refrigerant flow in a refrigerant flow path during operation, and actually functions as a three-way valve. The plurality of flow path switching valves 42 will hereinafter also be referred to as a first flow path switching valve 42*a*, a second flow path switching valve 42*b*, and a third flow path switching valve 42*c*.

Each of the expansion valves 44 is an electric valve having an adjustable opening degree. Each of the expansion valves 44 has an opening degree adjusted in accordance with the operation condition, and decompresses the refrigerant passing therethrough in accordance with the opening degree. The plurality of expansion valves 44 will hereinafter also be referred to as a first expansion valve 44*a*, a second expansion valve 44*b*, a third expansion valve 44*c*, and a fourth expansion valve 44*d*.

The outdoor heat exchanger 43 is of a cross-fin type or a microchannel type. The outdoor heat exchanger 43 includes a first heat exchange unit 43*a*, a second heat exchange unit 43*b*, a third heat exchange unit 43*c*, and a fourth heat exchange unit 43*d*. The first heat exchange unit 43*a* has a gas side end connected to a refrigerant pipe extending to reach the third flow path switching valve 42*c*. The first heat exchange unit 43*a* has a liquid side end connected to a refrigerant pipe extending to reach the first expansion valve 44*a*.

The second heat exchange unit 43*b* has a gas side end connected to a refrigerant pipe extending to reach the first flow path switching valve 42*a*. The second heat exchange unit 43*b* has a liquid side end connected to a refrigerant pipe extending to reach the second expansion valve 44*b*.

The third heat exchange unit 43*c* and the fourth heat exchange unit 43*d* each have a gas side end connected to a refrigerant pipe extending from the oil separator 46 and branched. The third heat exchange unit 43*c* and the fourth heat exchange unit 43*d* each have a liquid side end connected to a refrigerant pipe extending to reach the third expansion valve 44*c*.

The subcooler 45 includes a first heat transfer tube 45*a* and a second heat transfer tube 45*b*. The first heat transfer tube 45*a* has a first end connected to a refrigerant pipe extending to reach the first to third expansion valves 44*a*, 44*b*, and 44*c*. The first heat transfer tube 45*a* has a second end connected to a refrigerant pipe extending to reach the third shutoff valve 39*c*. The second heat transfer tube 45*b* has a first end connected to a first branching tube 53 branching from a refrigerant pipe provided between the first heat transfer tube 45*a* and the first to third expansion valves 44*a*, 44*b*, and 44*c*. The first branching tube 53 is provided with the fourth expansion valve 44*d*. The second heat transfer tube 45*b* has a second end connected to a first end of an injection pipe 55. The injection pipe 55 has a second end connected to an intermediate port of the compressor 40.

The injection pipe 55 is connected with a first end of a second branching tube 56. The second branching tube 56 has a second end (outlet end) connected to the suction pipe 47. The second branching tube 56 is provided with a second on-off valve 57 and a check valve 58. The second on-off valve 57 is an electromagnetic valve.

The subcooler 45 causes heat exchange between the refrigerant flowing from the compressor 40, passing the outdoor heat exchanger 43 and the expansion valves 44, and flowing in the first heat transfer tube 45*a*, and the refrigerant decompressed by the expansion valve 44*d* and flowing in the second heat transfer tube 45*b*, to subcool the refrigerant flowing in the first heat transfer tube 45*a*. The refrigerant flowing in the second heat transfer tube 45*b* passes the injection pipe 55 and is sucked into the intermediate port of the compressor 40. When the second on-off valve 57 is opened, the refrigerant flowing in the injection pipe 55 branches into the second branching tube 56 to flow therein and passes the suction pipe 47 to be sucked into the compressor 40.

(Structure of Outdoor Unit)

Figure 2:
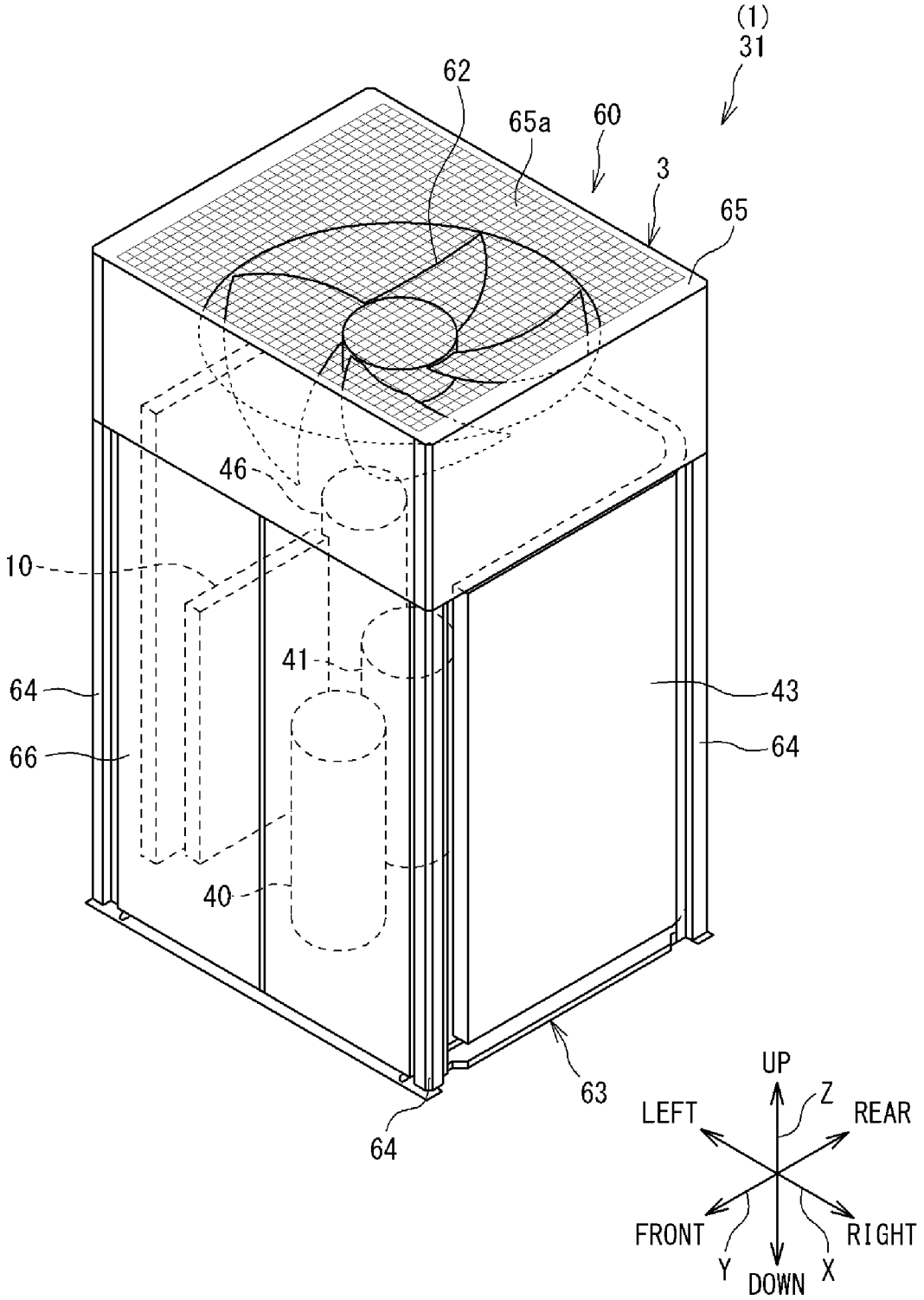
FIG. 2 is a perspective view of the refrigeration apparatus.
Figure 3:
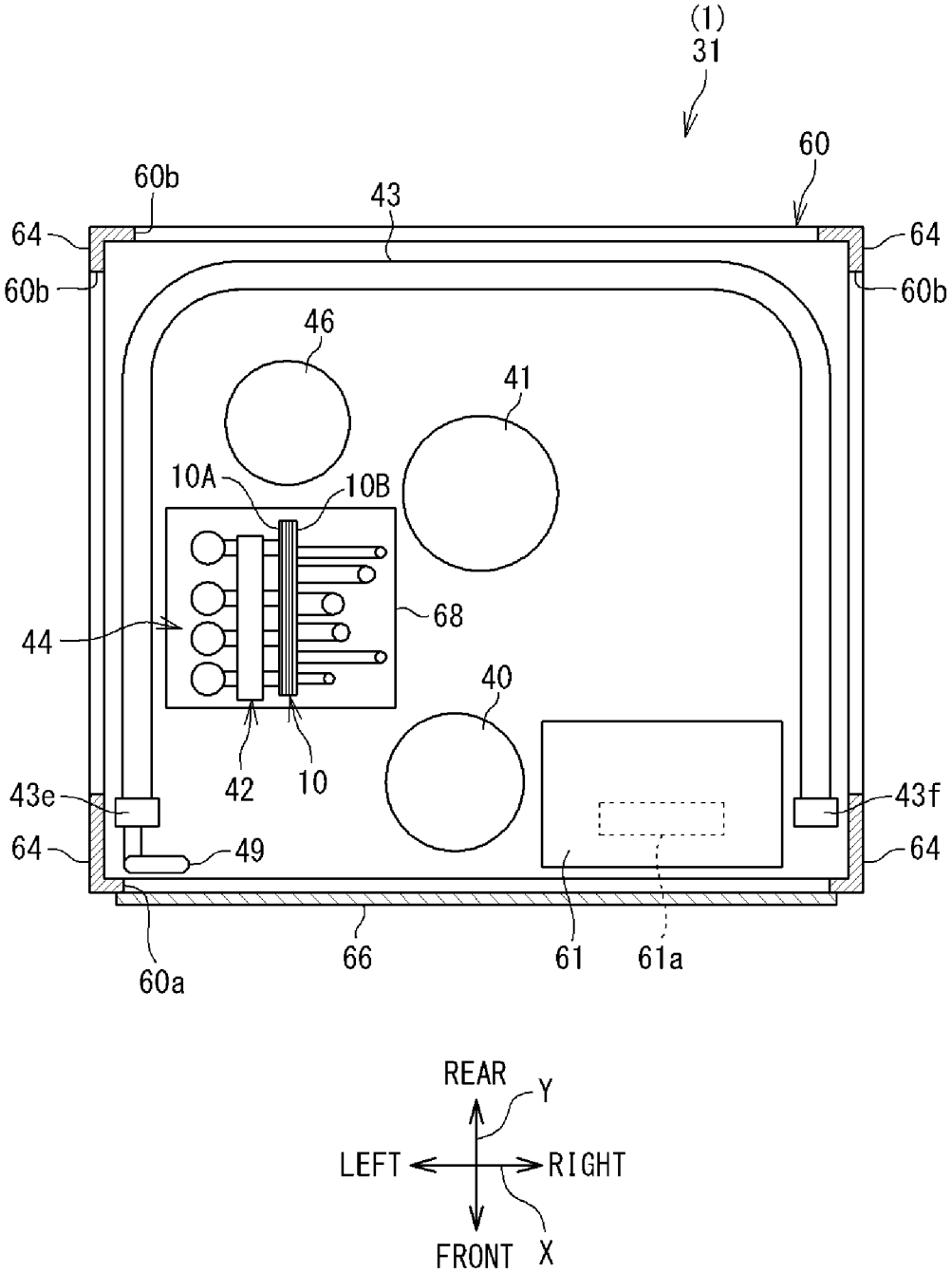
FIG. 3 is a plan view depicting the interior of the refrigeration apparatus.

Description is made below to the outdoor unit 31 in terms of its specific structure. FIG. 2 is a perspective view of the refrigeration apparatus. FIG. 3 is a plan view depicting the interior of the refrigeration apparatus.

The following description refers to a transverse direction, an anteroposterior direction, and a vertical direction according to arrows X, Y, and Z indicated in FIG. 2 and FIG. 3. Specifically in the following description, the arrow X in FIG. 2 and FIG. 3 indicates a first direction corresponding to the transverse direction, the arrow Y indicates a second direction corresponding to the anteroposterior direction, and the arrow Z indicates a third direction corresponding to the vertical direction. Note that these directions are described exemplarily without limiting the present disclosure. Alternatively, the first direction X may correspond to the anteroposterior direction and the second direction Y may correspond to the transverse direction.

As depicted in FIG. 2 and FIG. 3, the outdoor unit 31 includes a casing 60 accommodating components such as the compressor 40, the accumulator 41, the outdoor heat exchanger 43, and the oil separator 46 constituting the refrigerant circuit, an electric component unit 61, the fan 62, and the like. The fan 62 is provided at the top of the casing 60.

The casing 60 has a substantially rectangular parallelepiped shape. The casing 60 has a bottom plate 63, a support 64, a top panel 65, a front panel 66, and the like. The bottom plate 63 has a quadrilateral shape in a top view. The support 64 is a long member having a substantially L sectional shape and elongating in the vertical direction, and is attached to each of four corners of the bottom plate 63.

The top panel 65 has a quadrilateral shape substantially identically to the bottom plate 63, is disposed above and spaced apart from the bottom plate 63. The top panel 65 has four corners attached to upper ends of the supports 64. The top panel 65 is provided with a vent hole having a substantially quadrilateral shape and provided with a grill 65*a* preventing entry of foreign matters.

As depicted in FIG. 3, the casing 60 has a front surface provided with an opening 60*a* for maintenance. The opening 60*a* is closed by the front panel (front side plate) 66. Detaching the front panel 66 from the casing 60 enables maintenance, replacement, and the like of the components in the casing 60 via the opening 60*a*.

The bottom plate 63 of the casing 60 is provided thereon with the components such as the compressor 40, the accumulator 41, the outdoor heat exchanger 43, and the oil separator 46. The bottom plate 63 is provided thereon with a refrigerant flow path unit 10.

The outdoor heat exchanger 43 is disposed to oppose (face) three side surfaces of the casing 60. Specifically, the outdoor heat exchanger 43 has a U shape in atop view to extend along a left side surface, a right side surface, and a rear side surface of the casing 60. The outdoor heat exchanger 43 has a first end part provided with a gas header 43*e*, and a second end part provided with a liquid header 43*f*. The left side surface, the right side surface, and the rear side surface of the casing 60 are each provided with an intake port 60*b* for intake of outdoor air.

The outdoor unit 31 is configured to, when the fan 62 is driven, import air via the intake port 60*b* of the casing 60, cause heat exchange of the air in the outdoor heat exchanger 43, and then send out air upward from the top of the casing 60.

The compressor 40 is disposed at a substantially center in the transverse direction X in the vicinity of the front surface of the casing 60. The electric component unit 61 is disposed in the vicinity of the front surface of the casing 60 and adjacent to a right side of the compressor 40. The compressor 40 is provided therebehind with the accumulator 41. The accumulator 41 has a left side provided with the oil separator 46. The electric component unit 61 includes the controller 61*a* configured to control behavior of the compressor 40, the valves 42 and 44, the fan 62, and the like.

The refrigerant flow path unit 10 includes, collectively as a single unit, refrigerant pipes connecting components such as the compressor 40, the accumulator 41, the flow path switching valves 42, the outdoor heat exchanger 43, the expansion valves 44, and the oil separator 46. Specifically, the refrigerant flow path unit 10 according to one or more embodiments constitutes refrigerant flow paths disposed inside a frame F1 and outside frames F2 each indicated by a two-dot chain line in FIG. 1.

As depicted in FIG. 3, the refrigerant flow path unit 10 is disposed between the compressor 40 and the accumulator 41 in the anteroposterior direction and on the left side of the compressor 40 and the accumulator 41. The refrigerant flow path unit 10 is disposed ahead of the oil separator 46. The refrigerant flow path unit 10 is fixed onto the bottom plate 63 of the casing 60 with a supporting stand 68 interposed therebetween.

(Configuration of Refrigerant Flow Path Unit)

Figure 4:
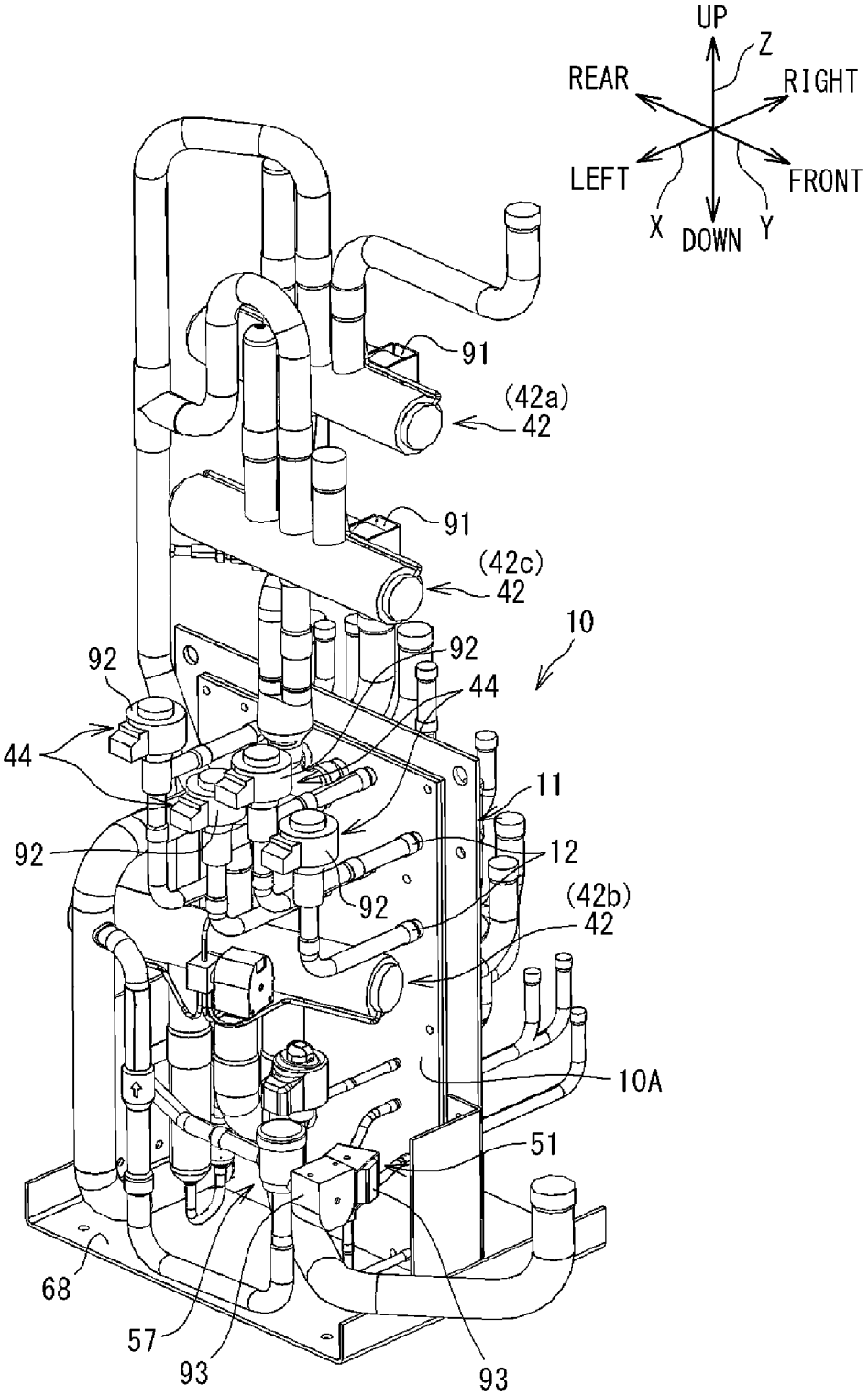
FIG. 4 is a perspective view of a first surface of a refrigerant flow path unit.
Figure 5:
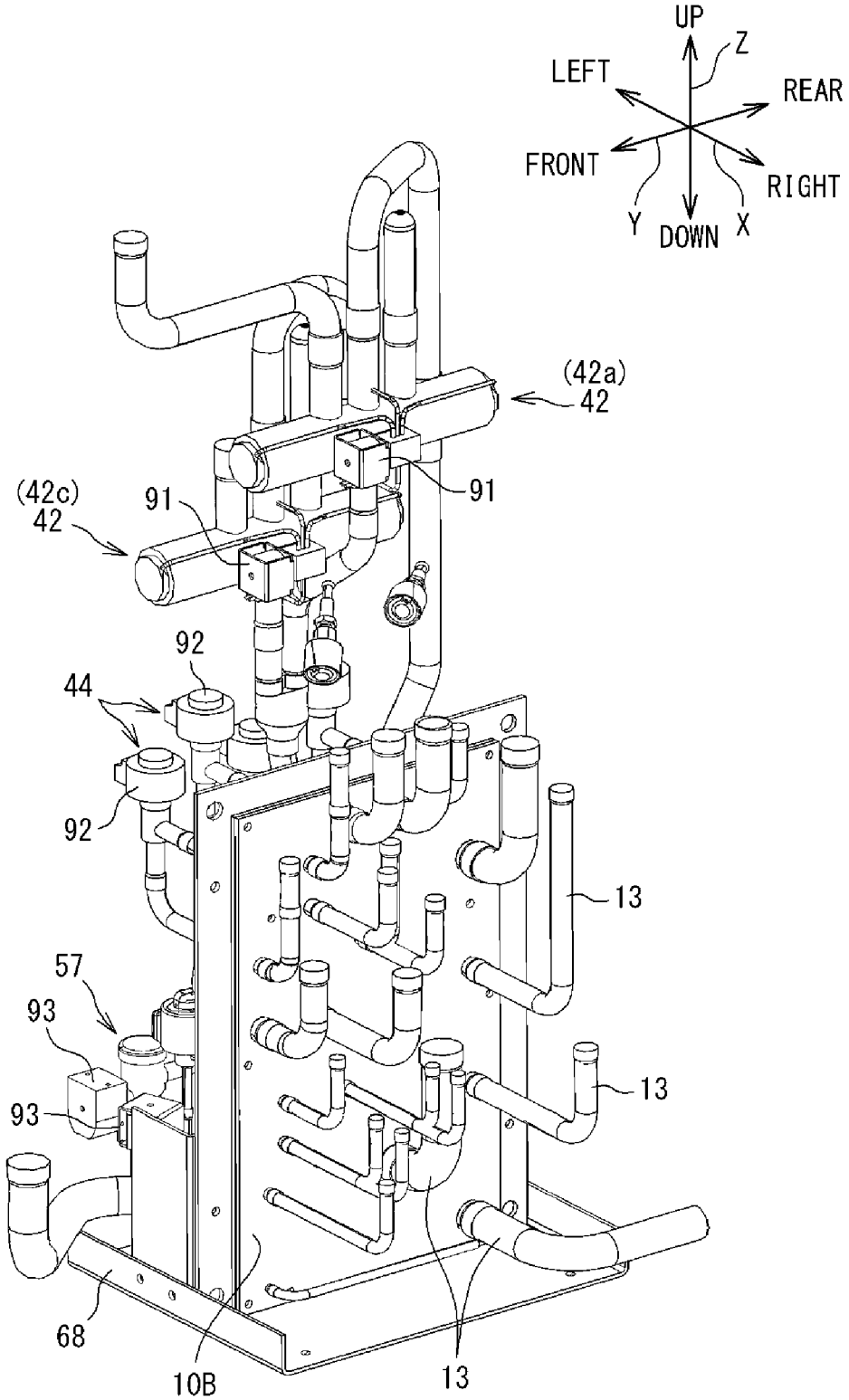
FIG. 5 is a perspective view of a second surface of the refrigerant flow path unit.

FIG. 4 is a perspective view of a first surface of the refrigerant flow path unit. FIG. 5 is a perspective view of a second surface of the refrigerant flow path unit.

The refrigerant flow path unit 10 according to one or more embodiments is fixed to the bottom plate 63 of the casing 60 for the outdoor unit 31 in an upstanding posture with the supporting stand 68 interposed therebetween. The refrigerant flow path unit 10 in the "upstanding posture" has surfaces 10A and 10B on both sides extending substantially in a perpendicular direction. Note that the "upstanding posture" according to the present disclosure also includes a posture with the surfaces 10A and 10B on the both sides being slanted by within ±45 degrees from the posture with the surfaces extending in the perpendicular direction.

As depicted in FIG. 4 and FIG. 5, the refrigerant flow path unit 10 is connected with the components of the refrigerant circuit, such as the flow path switching valves 42, the expansion valves (electric valves) 44, the on-off valves (electromagnetic valves) 51 and 57, the compressor 40, the accumulator 41, and the oil separator 46.

For example, the surface (first surface) 10A of the refrigerant flow path unit 10 is connected, via refrigerant pipes, with functional components exerting predetermined functions, such as the flow path switching valves 42, the expansion valves 44, and the on-off valves 51 and 57 as depicted in FIG. 4. The surface (second surface) 10B of the refrigerant flow path unit 10 is connected, via refrigerant pipes, with containers such as the compressor 40, the accumulator 41, and the oil separator 46. In the present disclosure, a component connected to the first surface 10A of the refrigerant flow path unit 10 may be called a first component, and a component connected to the second surface 10B may be called a second component.

The functional components such as the flow path switching valves 42, the expansion valves 44, and the on-off valves 51 and 57 are attached to the refrigerant flow path unit 10 via refrigerant pipes, and are supported by the refrigerant flow path unit 10. In other words, the refrigerant flow path unit 10 supports the functional components while receiving weights of the functional components via the refrigerant pipes. The functional components may alternatively be connected directly to the refrigerant flow path unit 10 via no refrigerant pipes.

The flow path switching valves 42, the expansion valves 44, and the on-off valves 51 and 57 are electric components including driving units 91, 92, and 93 such as motors or solenoids. These valves are thus connected with electric cables. The plurality of electric components connected to the identical surface 10A of the refrigerant flow path unit 10 facilitates wiring management such as bundling the electric cables and routing the electric cables to the electric component unit.

As depicted in FIG. 2, the first surface 10A and the second surface 10B of the refrigerant flow path unit 10 are directed to cross the front panel 66 of the casing 60 in a top view. Accordingly, detaching the front panel 66 from the casing 60 to expose the interior of the casing 60 via the opening 60*a* facilitates access to the components connected to both the first surface 10A and the second surface 10B, for easy maintenance and replacement of the components. According to one or more embodiments, the first surface 10A and the second surface 10B of the refrigerant flow path unit 10 are disposed perpendicularly to the front panel 66, but may alternatively be disposed obliquely thereto.

The second surface 10B of the refrigerant flow path unit 10 is directed to a side (right side) provided with the compressor 40 and the accumulator 41. In other words, the compressor 40 and the accumulator 41 are disposed closer to the second surface 10B than the first surface 10A. The compressor 40 and the accumulator 41 are connected to the second surface 10B via refrigerant pipes, to facilitate routing of the refrigerant pipes.

The refrigerant flow path unit 10 is provided, on the left side, with the gas header 43*e* of the outdoor heat exchanger 43. The gas header 43*e* is thus disposed closer to the first surface 10A than the second surface 10B of the refrigerant flow path unit 10. The gas header 43*e* is connected, via a refrigerant pipe 49, to the first surface 10A of the refrigerant flow path unit 10 or the flow path switching valve 42 connected to the first surface 10A. The gas header 43*e* is connected directly or indirectly to the first surface 10A disposed closer in this manner, to facilitate routing of the refrigerant pipe 49.

The compressor 40 is connected to the refrigerant flow path unit 10 via a refrigerant pipe. The refrigerant flow path unit 10 thus blocks vibration of the compressor 40, so that the vibration is unlikely to be transmitted to other components such as the flow path switching valves 42 and the expansion valves 44 connected to the refrigerant flow path unit 10. This facilitates vibration control measures for the refrigerant pipes and the like connecting the refrigerant flow path unit 10 and the other components, and also facilitates routing and the like of the refrigerant pipes.

(Specific Structure of Refrigerant Flow Path Unit)

Figure 6:
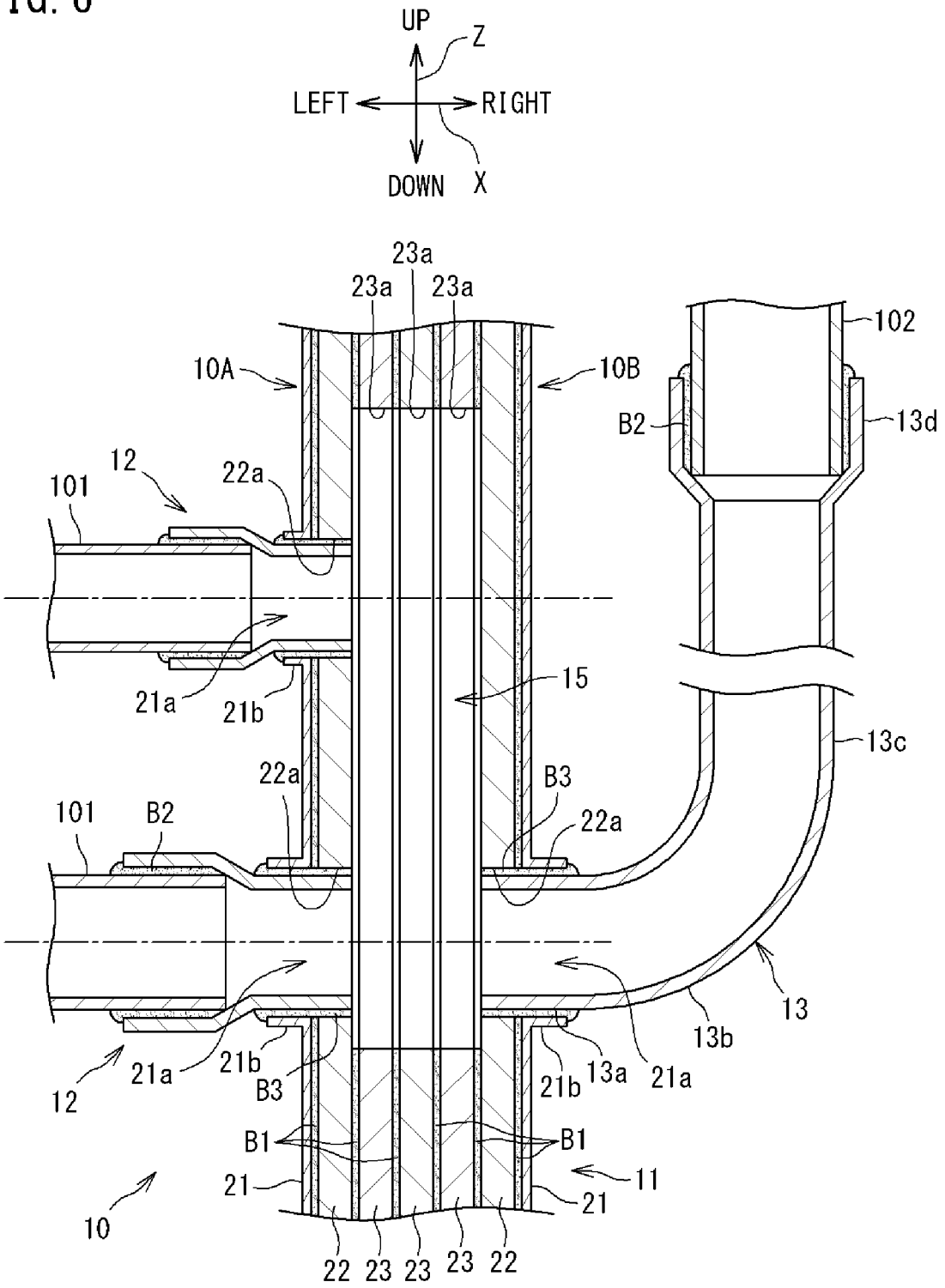
FIG. 6 is a partial sectional view of the refrigerant flow path unit.

FIG. 6 is a partial sectional view of the refrigerant flow path unit.

As depicted in FIG. 6, the refrigerant flow path unit 10 includes a unit body 11, a first joint tube 12, and a second joint tube 13.

The unit body 11 includes a plurality of plates 21, 22, and 23. The plurality of plates 21, 22, and 23 is stacked and joined together. The plates 21, 22, and 23 according to one or more embodiments are made of stainless steel. The unit body 11 is provided therein with a refrigerant flow path 15. The first surface 10A and the second surface 10B of the refrigerant flow path unit 10 according to one or more embodiments each correspond to a surface (outer surface) of the plate 21 disposed on the outermost side in a stacking direction among the plurality of plates 21, 22, and 23. The refrigerant flow path unit 10 according to one or more embodiments is disposed such that the stacking direction (normal direction) of the plurality of plates 21, 22, and 23 matches the transverse direction X of the outdoor unit 31.

The plurality of plates 21, 22, and 23 includes a first plate 21, a second plate 22 stacked on the first plate 21, and a third plate 23 stacked on the second plate 22. The plates 21, 22, and 23 adjacent to each other are joined by brazing.

The first plate 21 is disposed at each end part of the unit body 11 in the stacking direction of the plurality of plates 21, 22, and 23 (hereinafter, also simply called the "stacking direction X"). The first plate 21 is made thinner than the remaining second and third plates 22 and 23. The first plate 21 is provided with a connecting sleeve 21*b* protruding outward from the unit body 11 in the stacking direction X. The connecting sleeve 21*b* has a cylindrical shape. The connecting sleeve 21*b* has a sleeve axis extending in the stacking direction X. The connecting sleeve 21*b* has a sleeve interior constituting a first opening 21*a*. The first opening 21*a* is a circular hole penetrating the first plate 21. The connecting sleeve 21*b* and the first opening 21*a* are formed by burring the first plate 21.

The second plate 22 is positioned as a second one from each end in the stacking direction X. The second plate 22 is made thicker than the first plate 21. The second plate 22 is provided with a second opening 22*a*. The second opening 22*a* is a circular hole penetrating the second plate 22. The second opening 22*a* communicates with the first opening 21*a* in the first plate 21. The first opening 21*a* and the second opening 22*a* are identical in inner diameter.

The third plate 23 is disposed between the two second plates 22 spaced apart from each other in the stacking direction X. The two second plates 22 according to one or more embodiments interpose three third plates 23 stacked together. The third plates 23 are identical in thickness to the second plates 22. The second plates 22 and the third plates 23 can thus be formed by processing an identical material.

The third plates 23 are each provided with a third opening 23*a* constituting the refrigerant flow path 15. The third opening 23*a* is a hole penetrating each of the third plates 23 or a slit extending perpendicularly to the stacking direction X. FIG. 6 exemplifies a case where the third opening 23*a* is formed to range between two second openings 22*a* in the second plate 22 on a side (left side in FIG. 6) in the stacking direction X. The third opening 23*a* communicates with the second openings 22*a* in the second plate 22.

The first, second, and third plates 21, 22, and 23 may alternatively be made of a material other than stainless steel, such as aluminum, an aluminum alloy, or iron.

In the example shown in FIG. 6, the first joint tube 12 is attached to the first plate 21 and the second plate 22 disposed close to the first surface 10A of the refrigerant flow path unit 10. The first joint tube 12 is inserted to the first opening 21*a* and the second opening 22*a*. The first joint tube 12 has an outer circumferential surface joined by brazing with use of a brazing filler material B3 to an inner circumferential surface of the first opening 21*a* and an inner circumferential surface of the second opening 22*a*.

The inner circumferential surface of the first opening 21*a* indicates a surface constituting the first opening 21*a* in the first plate 21. Similarly, the inner circumferential surface of the second opening 22*a* indicates a surface constituting the second opening 22*a* in the second plate 22. The first joint tube 12 may alternatively be brazed only to the first plate 21.

The first joint tube 12 is connected with a different refrigerant pipe 101. As depicted in FIG. 4 and the like, the refrigerant pipe 101 extends from the flow path switching valve 42, the expansion valve 44, or the on-off valve 51 or 57. The refrigerant pipe 101 of this type is typically made of copper or a material chiefly containing copper, such as a copper alloy. The refrigerant pipe 101 has a first end part inserted to the first joint tube 12, and an outer circumferential surface of the refrigerant pipe 101 and an inner circumferential surface of the first joint tube 12 are joined by brazing with use of a brazing filler material B2.

In the example shown in FIG. 6, the second joint tube 13 is attached to the first plate 21 and the second plate 22 disposed close to the second surface 10B of the refrigerant flow path unit 10. The second joint tube 13 is connected with a different refrigerant pipe 102 linked to a container such as the compressor 40 or the accumulator 41. The second joint tube 13 has a first end part 13*a* inserted to the first opening 21*a* and the second opening 22*a*. The second joint tube 13 has an outer circumferential surface joined by brazing with use of the brazing filler material B3 to the inner circumferential surface of the first opening 21*a* and the inner circumferential surface of the second opening 22*a*. The second joint tube 13 may alternatively be brazed only to the first plate 21.

The second joint tube 13 has the first end part 13*a* connected to the first and second plates 21 and 22, a curved part 13*b* curved by 90 degrees from the first end part 13*a*, and a linear part 13*c* extending in the vertical direction Z from the curved part 13*b*. As depicted in FIG. 5, the refrigerant pipe 102 has a second end part 13*d* disposed upward or laterally in the refrigerant flow path unit 10 in the upstanding posture. This facilitates connecting, by burner brazing or the like, the different refrigerant pipe 102 extending from a container such as the compressor 40 to the second end part 13*d* of the second joint tube 13. The refrigerant pipe 102 has a first end part inserted to the second end part 13*d* of the second joint tube 13, and an outer circumferential surface of the refrigerant pipe 102 and an inner circumferential surface of the second end part 13*d* are joined by brazing with use of the brazing filler material B2.

The first joint tube 12 and the second joint tube 13 according to one or more embodiments are each made of copper or a material chiefly containing copper, such as a copper alloy. The first joint tube 12 may alternatively be made of a material other than the above, such as stainless steel, aluminum, an aluminum alloy, or iron.

The refrigerant flow path unit 10 may alternatively be constituted by the unit body 11, without including the first joint tube 12 and the second joint tube 13. In this case, the different refrigerant pipes 101 and 102 are directly connected to the first surface 10A and the second surface 10B of the refrigerant flow path unit 10. Still alternatively, the second joint tube 13 may be replaced with the first joint tube 12. In this case, a pipe curved into an L shape serving as the different refrigerant pipe 102 may be connected to the second joint tube 13.

Figure 7:
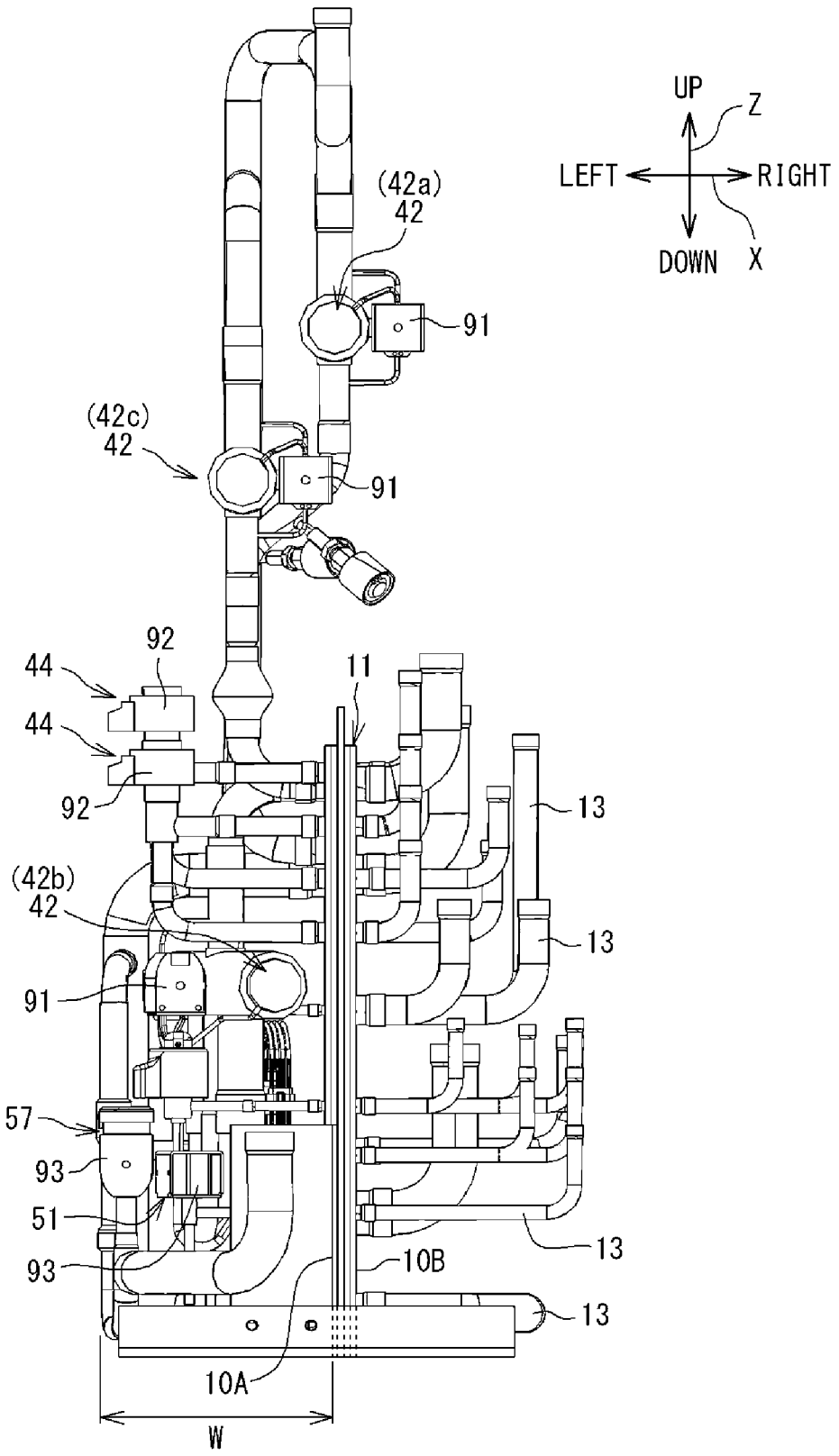
FIG. 7 is a front view of the refrigerant flow path unit.

FIG. 7 is a front view of the refrigerant flow path unit.

In FIG. 4 and FIG. 7, the plurality of (three) flow path switching valves 42 is disposed at levels different from one another. Two of the three flow path switching valves 42 are disposed at levels higher than the refrigerant flow path unit 10. The flow path switching valve 42 at the highest level is positioned to be overlapped with an upper portion of the unit body 11 in the refrigerant flow path unit 10. The flow path switching valve 42 at a vertically intermediate level and the flow path switching valve 42 at the lowest level are disposed closer to the first surface 10A than the unit body 11. In one or more embodiments, the flow path switching valve 42 at the highest level and the flow path switching valve 42 at the vertically intermediate level correspond to the first and third flow path switching valves 42*a* and 42*c* in FIG. 3, and the flow path switching valve 42 at the lowest level corresponds to the second flow path switching valve 42*b*.

Each of the flow path switching valves 42 is provided, on a side surface in the transverse direction X, with the driving unit 91 constituted by a solenoid. The driving unit 91 corresponds to a maintenance target part as a target of maintenance such as adjustment or replacement. The plurality of flow path switching valves 42 is disposed at the levels different from one another, and the driving units 91 are thus positioned not to be overlapped with one another when viewed from ahead. As depicted in FIG. 2, when the front panel 66 of the casing 60 is detached to reveal the opening 60*a* for maintenance, the driving units 91 can be accessed via the opening 60*a* for easier maintenance of the driving units 91.

As depicted in FIG. 7, the plurality of (two) on-off valves 51 and 57 includes driving units 93 constituted by solenoids, respectively. The driving units 93 each correspond to a maintenance target part as a target of maintenance such as adjustment or replacement. The driving units 93 are disposed at substantially equal levels, but are displaced from each other in the transverse direction. The driving units 93 of the plurality of on-off valves 51 and 57 are thus positioned not to be overlapped with each other when viewed from ahead. As depicted in FIG. 2, when the front panel 66 of the casing 60 is detached to reveal the opening 60*a* for maintenance, the driving units 93 can be accessed via the opening 60*a* for easier maintenance of the driving units 93.

The driving units 91 of the plurality of flow path switching valves 42 and the driving units 93 of the plurality of on-off valves 51 and 57 are positioned not to be overlapped with one another when viewed from ahead. This facilitates access to the driving units 91 and 93 via the opening 60*a* for maintenance.

Figure 8:
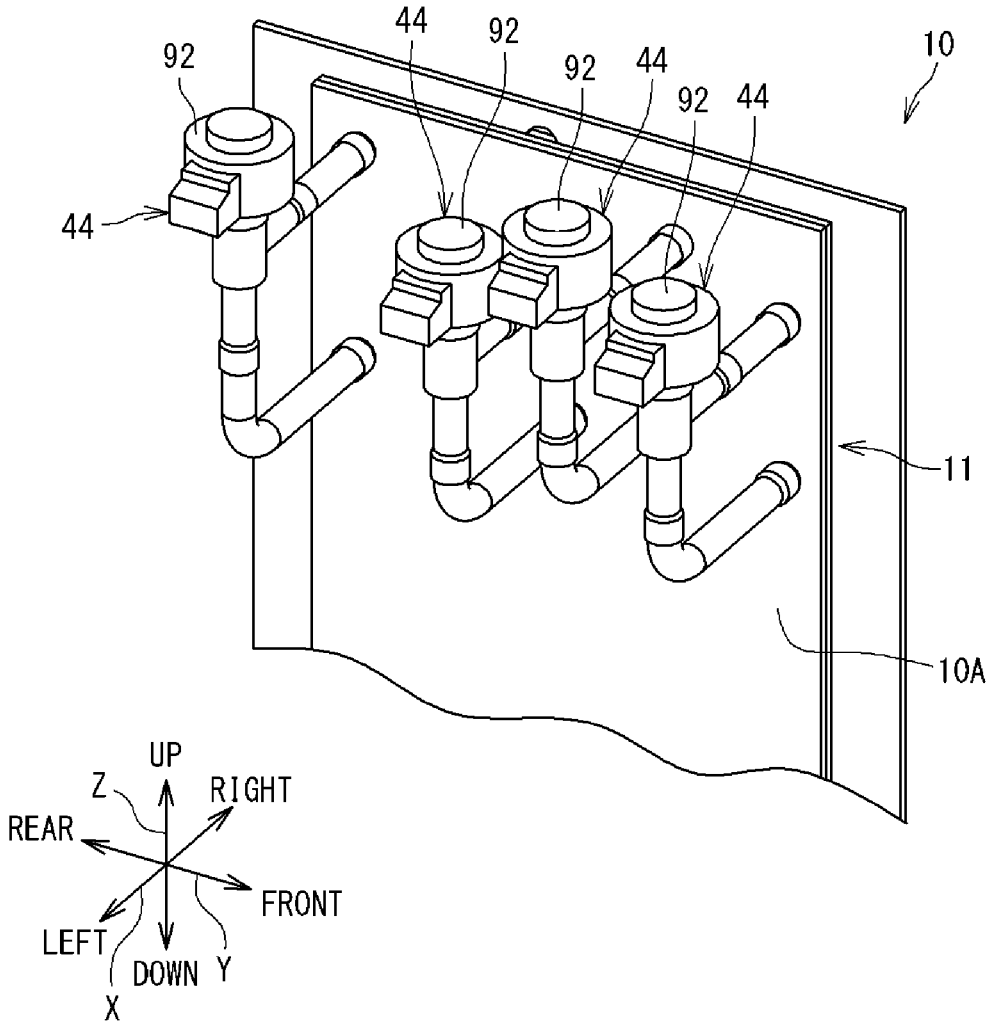
FIG. 8 is a perspective view of a plurality of expansion valves attached to the refrigerant flow path unit.

FIG. 8 is a perspective view of the plurality of expansion valves attached to the first surface of the refrigerant flow path unit.

As depicted in FIG. 7 and FIG. 8, each of the expansion valves 44 has an upper end provided with the driving unit 92 such as a motor. The driving unit 92 also corresponds to a maintenance target part as a target of maintenance such as adjustment or replacement. The first surface 10A of the refrigerant flow path unit 10 according to one or more embodiments is provided with the plurality of (four) expansion valves 44 aligned in the anteroposterior direction. The driving units 92 of the plurality of expansion valves 44 are positioned to be overlapped with one another when viewed from ahead.

Figure 9:
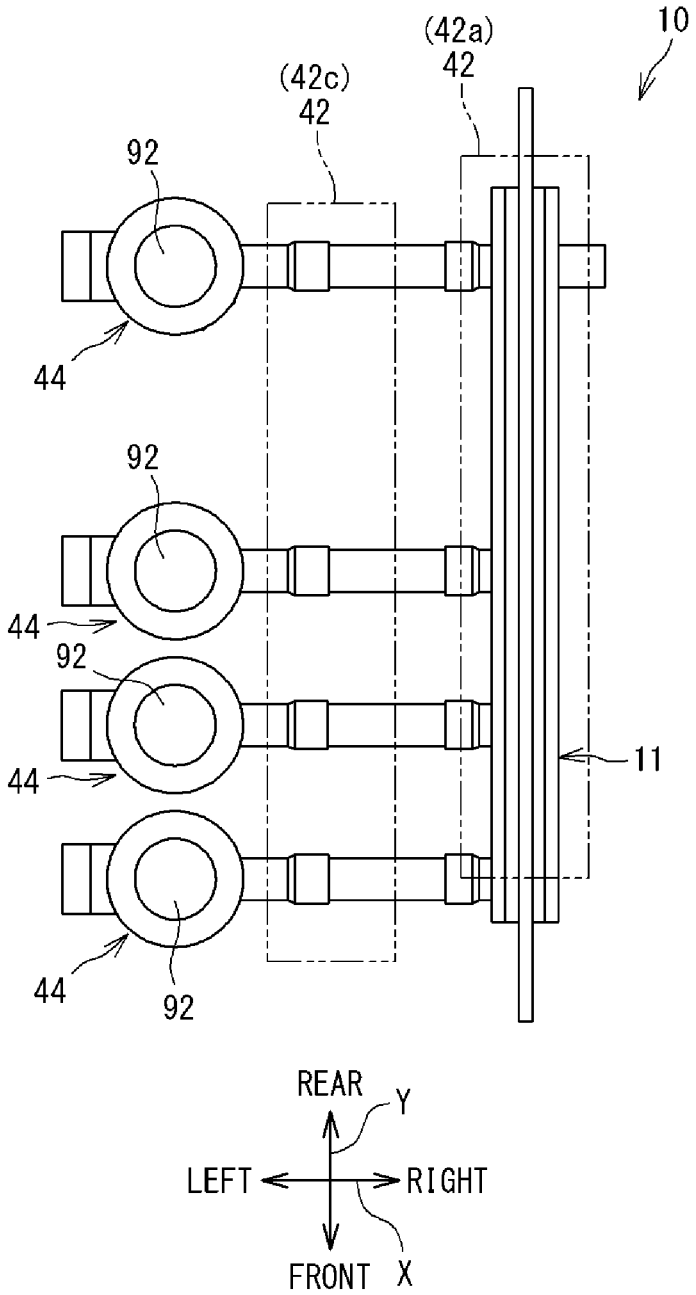
FIG. 9 is a plan view of the plurality of expansion valves attached to the refrigerant flow path unit.

FIG. 9 is a plan view of the plurality of expansion valves attached to the first surface of the refrigerant flow path unit.

The driving units 92 of the plurality of expansion valves 44 are positioned not to be overlapped with one another in a top view. As depicted in FIG. 7, no other components attached to the refrigerant flow path unit 10 are disposed right above the driving units 92 of the plurality of expansion valves 44. For example, the flow path switching valve 42*c* at the vertically intermediate level is positioned closer to the first surface 10A in the transverse direction X than the driving units 92 of the expansion valves 44, so as not to be overlapped with the driving units 92. There is thus no obstacle in a space above each of the driving units 92, for easy maintenance of the driving units 92 from above.

As depicted in FIG. 4 to FIG. 7, the plurality of on-off valves 51 and 57 is displaced from each other in the transverse direction X. The driving units 93 of the on-off valves 51 and 57 are thus positioned not to be overlapped with each other when viewed from above. This facilitates maintenance from above, of the driving units 93 of the on-off valves 51 and 57.

The flow path switching valve 42*a* at the highest level and the flow path switching valve 42*c* at the vertically intermediate level are positioned to be higher than the refrigerant flow path unit 10. This leads to easy avoidance of interference with the different components connected to the first surface 10A of the refrigerant flow path unit 10. As depicted in FIG. 7, any component attached to the first surface 10A of the refrigerant flow path unit 10 can be reduced in protruding length W from the first surface 10A. This achieves reduction in footprint of the refrigerant flow path unit 10 on the bottom plate 63 of the casing 60, for more flexible disposition of the refrigerant flow path unit 10.

The flow path switching valve 42*a* at the highest level is positioned to be overlapped with the upper portion of the unit body 11 in the refrigerant flow path unit 10. This achieves effective use of a space above the refrigerant flow path unit 10 and easy avoidance of interference between the flow path switching valve 42*a* and the different components (the remaining flow path switching valves 42*b* and 42*c*, the refrigerant pipes, and the like).

Action and Effects of Embodiments

For example, according to the technique described in PATENT LITERATURE 1, only one of the surfaces of the substrate (the refrigerant flow path unit) is connected with components constituting a refrigerant circuit, such as the compressor and the four-way switching valve. The substrate thus needs to have a large area, which leads to increase in size of the substrate. Therefore, one or more embodiments of the present disclosure provide a refrigeration apparatus enabling reduction in size of a refrigerant flow path unit.

Action and Effects (1) The refrigeration apparatus 1 according to the embodiments described above includes the refrigerant flow path unit 10 that includes the plurality of plates 21, 22, and 23 stacked together and is provided therein with the refrigerant flow path 15, the first components 42, 44, 51, and 57 and the second components 40, 41, and 46 constituting the refrigerant circuit 30, and the casing 60 accommodating the refrigerant flow path unit 10 and the first and second components. The refrigerant flow path unit 10 has the first surface 10A and the second surface 10B on the both sides in the normal direction of the plates 21, 22, and 23, and is disposed in the casing 60 in the posture with the first surface 10A and the second surface 10B being upstanding. The first components 42, 44, 51, and 57 are connected to the first surface 10A, and the second components 40, 41, and 46 are connected to the second surface 10B.

In the refrigeration apparatus 1 thus configured, both the first surface 10A and the second surface 10B of the refrigerant flow path unit 10 are connected with the first and second components, respectively. The refrigerant flow path unit 10 can thus be reduced in area of the first surface 10A and the second surface 10B, for reduction in size of the refrigerant flow path unit 10.

(2) The first component according to the above embodiments is the functional components 42, 44, 51, and 57 supported by the refrigerant flow path unit 10. Meanwhile, the second component is the compressor 40 supported by the casing 60. The refrigerant flow path unit 10 thus blocks vibration of the compressor 40, so as to inhibit transmission of the vibration to the first components 42, 44, 51, and 57 connected to the refrigerant flow path unit 10.

(3) The compressor 40 according to the above embodiments is disposed closer to the second surface 10B than the first surface 10A. This facilitates routing of the refrigerant pipe provided between the compressor 40 and the refrigerant flow path unit 10.

(4) The refrigerant flow path unit 10 according to the above embodiments includes the second joint tube 13 configured to connect a pipe linked to each of the second components 40, 41, and 46, the first end of the second joint tube 13 is connected to the second surface 10B, and the second end of the second joint tube 13 is directed upward. This facilitates connecting (brazing) between the refrigerant pipe linked to each of the second components 40, 41, and 46 and the second joint tube 13.

(5) The casing 60 according to the above embodiments is provided in a side surface with the opening 60*a* for maintenance, and includes the side plate 66 configured to close the opening 60*a* and be detachable. The first surface 10A and the second surface 10B are directed to cross the side plate 66. In a state where the side plate 66 is detached, the first surface 10A and the second surface 10B of the refrigerant flow path unit 10 are thus accessible via the opening 60*a* for maintenance, to enable maintenance of the first and second components.

(6) The first components 42, 44, 51, and 57 according to the above embodiments include a first functional component and a second functional component supported by the refrigerant flow path unit 10. For example, the first functional component corresponds to one of the plurality of flow path switching valves 42 and the plurality of on-off valves 51 and 57, and the second functional component corresponds to another one of the plurality of flow path switching valves 42 and the plurality of on-off valves 51 and 57. The first functional component and the second functional component have the maintenance target parts, such as the driving units 91 and 93, which are positioned not to be overlapped with each other when viewed from the opening 60*a*. The maintenance target parts of the first functional component and the second functional component can thus be maintained easily via the opening 60*a* of the casing 60.

(7) The first component according to the above embodiments includes a third functional component and a fourth functional component of similar types, supported by the refrigerant flow path unit. For example, the third functional component corresponds to one of the plurality of expansion valves 44 and the plurality of on-off valves 51 and 57, and the fourth functional component corresponds to another one of the plurality of expansion valves 44 and the plurality of on-off valves 51 and 57. The third functional component and the fourth functional component have the maintenance target parts positioned not to be overlapped with each other when viewed from above. The maintenance target parts of the third functional component and the fourth functional component can be maintained easily from above.

(8) The refrigeration apparatus 1 according to the above embodiments includes the heat exchanger 43 accommodated in the casing 60 and including the header 43*e*, and the header 43*e* is connected to the first surface 10A disposed closer in the first surface 10A and the second surface 10B.

This configuration facilitates routing of the refrigerant pipe provided between the header 43*e* and the refrigerant flow path unit 10.

The present disclosure should not be limited to the above exemplification, but is intended to include any modification recited in the claims within meanings and a scope equivalent to those of the claims.

For example, the number of the plates constituting the refrigerant flow path unit 10 should not be limited to the number according to the above embodiments. Furthermore, the unit body 11 of the refrigerant flow path unit 10 is not limited to a plate shape, but may have any form such as a block shape.

The components connected to the first surface 10A and the second surface 10B of the refrigerant flow path unit 10 can be changed appropriately in terms of the types. One or a plurality of functional components may be connected to the second surface 10B, and one or a plurality of containers may be connected to the first surface 10A.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 refrigeration apparatus
10 refrigerant flow path unit

10A first surface
10B second surface
15 refrigerant flow path
21 plate
22 plate
23 plate
30 refrigerant circuit
40 compressor (second component, container)
41 accumulator (second component, container)
42 flow path switching valve (first component, functional component)
43 outdoor heat exchanger
43*e* gas header
44 expansion valve (first component, functional component)
46 oil separator (second component, container)
51 first on-off valve (first component, functional component)
57 second on-off valve (first component, functional component)
60 casing
60*a* opening
66 front panel (side plate)
91 driving unit
92 driving unit
93 driving unit

What is claimed is:

1. A refrigeration apparatus comprising:
a refrigerant flow path unit:
that comprises plates stacked together, and
in which a refrigerant flow path is disposed;
first components that are functional components that are valves each comprising a driver;
second components other than the functional components, wherein the first components and the second components constitute a refrigerant circuit; and
a casing accommodating:
the refrigerant flow path unit, and
the first and second components, wherein
the refrigerant flow path unit:
has a first surface and a second surface on opposite sides in a normal direction of the plates, and
is disposed in the casing in a posture with the first surface and the second surface being upstanding,
the first components are connected to the first surface,
the second components are connected to the second surface,
the refrigerant flow path unit comprises joint tubes that connect pipes linked to the second components,
each of the joint tubes has:
a first end connected to the second surface; and
a second end directed upward,
each of the pipes is inserted into the second end of a corresponding joint tube of the joint tubes,
a brazing filler material disposed between an outer circumferential surface of each of the pipes and an inner circumferential surface of each of the joint tubes joins the outer circumferential surface of each of the pipes to the inner circumferential surface of each of the joint tubes, and
the driver of each of the first components is disposed not to overlap with the driver of any other one of the first components when viewed:
from above, or
from a direction horizontal and parallel to the first and second surfaces.

2. The refrigeration apparatus according to claim 1, wherein the first components are supported by the refrigerant flow path unit.

3. The refrigeration apparatus according to claim 1, wherein one of the second components is a compressor supported by the casing.

4. The refrigeration apparatus according to claim 3, wherein the compressor is disposed closer to the second surface than to the first surface.

5. The refrigeration apparatus according to claim 1, wherein one of the first components is a flow path switching valve.

6. The refrigeration apparatus according to claim 1, wherein
the casing has a side surface having an opening for maintenance,
the casing includes a side plate configured to close the opening and that is detachable, and
the first surface and the second surface are directed to cross the side plate.

7. The refrigeration apparatus according to claim 6, wherein
the first components include a first functional component and a second functional component that are supported by the refrigerant flow path unit,
the first functional component and the second functional component each comprise a maintenance target part, and
the maintenance target part of the first functional component is disposed not to overlap with the maintenance target part of the second functional component when viewed from the opening.

8. The refrigeration apparatus according to claim 7, wherein
the first functional component and the second functional component are flow path switching valves, and
drivers of the flow path switching valves are each the maintenance target part.

9. The refrigeration apparatus according to claim 1, wherein
the first components include a first functional component and a second functional component that are supported by the refrigerant flow path unit,
the first functional component and the second functional component each comprise a maintenance target part, and
the maintenance target part of the first functional component is disposed not to overlap with the maintenance target part of the second functional component when viewed from above.

10. The refrigeration apparatus according to claim 9, wherein
each of the first functional component and the second functional component is an electric valve or an electromagnetic valve, and
a driver of the electric valve or the electromagnetic valve is the maintenance target part.

11. The refrigeration apparatus according to claim 1, further comprising:
a heat exchanger accommodated in the casing and including a header, wherein
the header is connected to one of the first surface and the second surface that is closer to the header.

* * * * *